US010597188B2

(12) United States Patent
Johnson

(10) Patent No.: US 10,597,188 B2
(45) Date of Patent: Mar. 24, 2020

(54) CONFIGURABLE CONTAINER ASSEMBLY

(71) Applicant: Ron Johnson, Grand Junction, CO (US)

(72) Inventor: Ron Johnson, Grand Junction, CO (US)

(73) Assignee: Tailgate N Go, Grand Junction, CO (US)

( * ) Notice: Subject to any disclaimer, the term of this patent is extended or adjusted under 35 U.S.C. 154(b) by 28 days.

(21) Appl. No.: 16/177,569

(22) Filed: Nov. 1, 2018

(65) Prior Publication Data

US 2019/0127109 A1 May 2, 2019

Related U.S. Application Data

(60) Provisional application No. 62/580,652, filed on Nov. 2, 2017.

(51) Int. Cl.

| | |
|---|---|
| ***B65D 5/38*** | (2006.01) |
| ***B65D 25/08*** | (2006.01) |
| ***B65D 25/06*** | (2006.01) |
| ***B65D 25/20*** | (2006.01) |
| ***B65D 25/10*** | (2006.01) |
| ***B65D 6/02*** | (2006.01) |
| ***B65D 43/16*** | (2006.01) |
| ***B65D 25/00*** | (2006.01) |
| ***B65D 6/00*** | (2006.01) |
| ***B65D 25/02*** | (2006.01) |
| ***B65D 25/04*** | (2006.01) |
| *B65D 55/14* | (2006.01) |

(52) U.S. Cl.

CPC ..... *B65D 5/38* (2013.01); *B65D 7/06* (2013.01); *B65D 11/10* (2013.01); *B65D 25/005* (2013.01); *B65D 25/02* (2013.01); *B65D 25/04* (2013.01); *B65D 25/06* (2013.01); *B65D 25/08* (2013.01); *B65D 25/10* (2013.01); *B65D 25/20* (2013.01); *B65D 43/16* (2013.01); *B65D 55/14* (2013.01); *B65D 2519/00288* (2013.01); *B65D 2543/00194* (2013.01)

(58) Field of Classification Search

USPC ..... 206/216, 223, 541, 542, 546, 577, 576

See application file for complete search history.

(56) References Cited

U.S. PATENT DOCUMENTS

| | | | | | |
|---|---|---|---|---|---|
| 2,603,500 | A * | 7/1952 | Messier | A47B 31/00 | 280/30 |
| 3,217,867 | A * | 11/1965 | Harris | B65D 75/36 | 206/468 |
| 4,706,817 | A * | 11/1987 | Greathouse | A47B 31/02 | 126/25 R |
| 6,138,831 | A * | 10/2000 | Agostinelli | B60R 7/04 | 206/217 |
| 2014/0299505 | A1* | 10/2014 | Stahle | A45F 3/46 | 206/546 |

* cited by examiner

*Primary Examiner* — Jacob K Ackun

(74) *Attorney, Agent, or Firm* — Leyendecker & Lemire, LLC

(57) ABSTRACT

A configurable container assembly is described. Embodiments of the configurable container assembly can include a container having a plurality of slots located around a perimeter of a top of the container. The slots can be configured to receive protrusions of one or more accessories. The configurable container assembly can be implemented in a closed configuration and an open configuration.

20 Claims, 7 Drawing Sheets

CONFIGURABLE CONTAINER ASSEMBLY

CROSS-REFERENCE TO RELATED APPLICATION

This application claims the benefit of U.S. Provisional Application No. 62/580,652, filed Nov. 2, 2017.

BACKGROUND

Currently available travel containers are numerous and provide many different features. Some travel containers include coolers, table functionality, and various internal storage compartments. Typically, however, currently available travel containers do not provide a plurality of accessories that can be stored internally of the container and then removed and coupled to an exterior of the container.

As such, there is a need for configurable container assembly that can include a means for attaching accessories to an interior and an exterior of the container.

DETAILED DESCRIPTION

Figure 1:
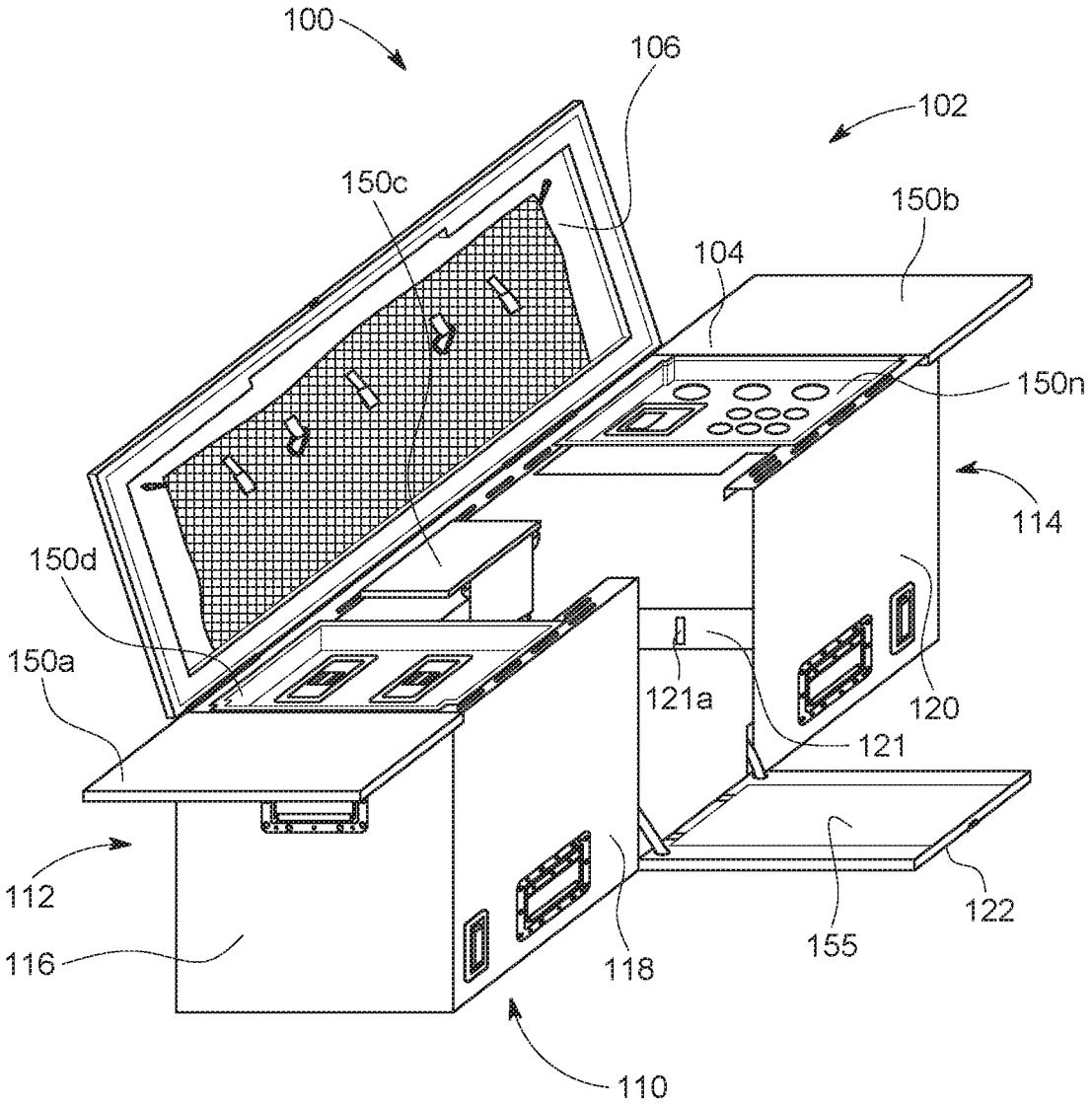
FIG. 1 is a perspective view of a configurable container assembly according to one embodiment of the present invention.

Embodiments of the present invention include a configurable container assembly. The configurable container assembly can include, but is not limited to, a container and one or more accessories configured to be attached to the container. The container can be defined by a lid, a back wall, a left sidewall, a right sidewall, a front left wall, a front right wall, a front middle wall, and a bottom. Components of the configurable container assembly can be manufactured from rigid materials, semi-rigid materials, or a combination of both. For instance, the container may be manufactured from aluminum. In another embodiment, the container may be manufactured from a rigid plastic. For instance, a rotational molding (or rotomolding) process may be implemented to manufacture the container from a rigid plastic. The lid can be rotatably coupled to a top of the back wall and the front middle wall can be rotatably coupled to a front portion of the bottom. The rotatable front middle wall may also be coupled to the front left wall and the front right wall via a pair of cables for added support.

A top of the left sidewall, the right sidewall, the front left wall, and the front right wall may each include a first plurality of slots and a second plurality of slots. A top of the back wall can include a plurality of slots. Typically, the first plurality of slots and the second plurality of slots can be aligned parallel to one another, although they do not need to be. Of note, the first plurality of slots can be implemented for coupling accessories for use outside the container and the second plurality of slots can be implemented for coupling accessories for use inside the container. As can be appreciated, the first plurality of slots can be located closer to an outside of the container and the second plurality of slots can be located closer to an interior of the container. The plurality of slots of the back wall can be implemented for coupling accessories for an interior of the container.

Each of the plurality of slots can be implemented to receive a tab or protrusion therethrough to couple an accessory to the container. As can be appreciated, accessories can be adapted to include one or more tabs for inserting into one of the plurality of slots for coupling said accessory to the container. For example, a camping burner stove may be retrofitted with an adapter having a pair of tabs to couple the burner stove to the container. Typically, the accessories can be sized and shaped to fit inside the container for transport when not in use or during travel. In one embodiment, one or more accessories can be coupled to the second plurality of slots when the container is being transported. Once the container reaches its destination and the container is in an open configuration, the one or more accessories can be moved from the second plurality of slots to one of the first plurality of slots. For example, a multi-tray accessory may be stored in the container and coupled to the second plurality of slots while stored, and then once the container is in the open configuration, the multi-tray accessory may be placed outside the container and coupled to the first plurality of slots.

The rotating front middle wall can include a slot for receiving a plate or other board (e.g., a cutting board). The cutting board may be removably inserted into a back side of the front middle wall such that when the front middle wall is rotated down, the cutting board can be used.

Typically, an interior of the configurable container assembly can include one or more storage spaces defined by interior walls included in the configurable container assembly. The interior walls can be integrated with the container. In one embodiment, one or more accessories can be stored via the interior walls. For instance, the walls may include slots for receiving and securing an accessory. In another instance, the walls may include compression clips for securing one or more accessories. In one example, a table accessory can be inserted into the slot of the interior walls and stored therein.

In one example embodiment, the configurable container assembly can be defined by a bottom, a left sidewall and a right sidewall, a back wall, a lid coupled to the back wall, a front left wall and a front right wall, and a front middle wall located between the front left wall and the front right wall. The front middle wall can be adapted to rotate between being vertical and horizontal. A first plurality of slots can be located on top of and proximate to an interior edge of the back wall, the left sidewall, the right sidewall, the front left wall, and the front right wall. A second plurality of slots located on top of and proximate to an exterior edge of the left sidewall, the right sidewall, the front left wall, and the front right wall. A plurality of accessories can be configured to mate with the first plurality of slots and the second plurality of slots.

The configurable container assembly can include a first configuration where (i) the lid is closed, (ii) each of the plurality of accessories are located inside the container, (iii) at least one of the plurality of accessories is mated with one of the first plurality of slots, and (iv) the front middle wall is vertical. The configurable container assembly can include a second configuration where (i) the lid is open, (ii) one or more of the plurality of accessories are located outside of the container, (iii) the front middle wall is horizontal, and (iv) at least one of the plurality of accessories is mated with one or more of the second plurality of slots.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

A First Embodiment of a Configurable Container Assembly

Referring to FIG. 1, a detailed diagram of an embodiment 100 of a configurable container assembly is illustrated. The configurable container assembly 100 can be implemented as a storage container in a closed position and as a food preparation station in an open configuration.

As shown in FIG. 1, the configurable container assembly 100 can include a container 102 and one or more accessories 150*a*-150*n* (shown generally in the figures). The one or more accessories can be configured to be removably coupled inside and/or outside of the container 102. The container 102 can include, but is not limited to, a body 104, a lid 106, and a plurality of slots 108 (shown in FIG. 2). The body 104 can be defined by a bottom 110, a left sidewall 112, a right sidewall 114, a back wall 116, a front left sidewall 118, a front right sidewall 120, a pair of partition (or dividing) walls 121, and a front middle wall 122. The plurality of slots 108 can typically be located on top of the left sidewall 112, the right sidewall 114, the back wall 116, the front left sidewall 118, and the front right sidewall 120.

Of note, various accessories 150*a*-150*n* are shown in the figures. For instance, as shown in FIG. 1, an accessory 150*a* may be a table or board accessory, an accessory 150*b* may be a table or board accessory, an accessory 150*c* may be a paper towel holder accessory, an accessory 150*d* may be a food tray accessory, and the accessory 150*n* may be a condiment/spice rack accessory. It is to be appreciated that these accessories are shown for illustrative purposes only and not meant to be limiting. Any number of types of accessories may be implemented with the configurable container assembly 100. For instance, a stove may be implemented or a cooler can be implemented with the configurable container assembly 100. Typically, any type of accessory may be implemented assuming the accessory may be retrofitted or have integrated one or more protrusions 152 (described and shown hereinafter) to couple to the slots 108 of the container 102.

Typically, the lid 106 can have a rotatable connection to the body 104. For instance, one or more hinged couplings can be implemented to rotatably couple the lid 106 to the back wall 116 of the body 104.

Figure 2:
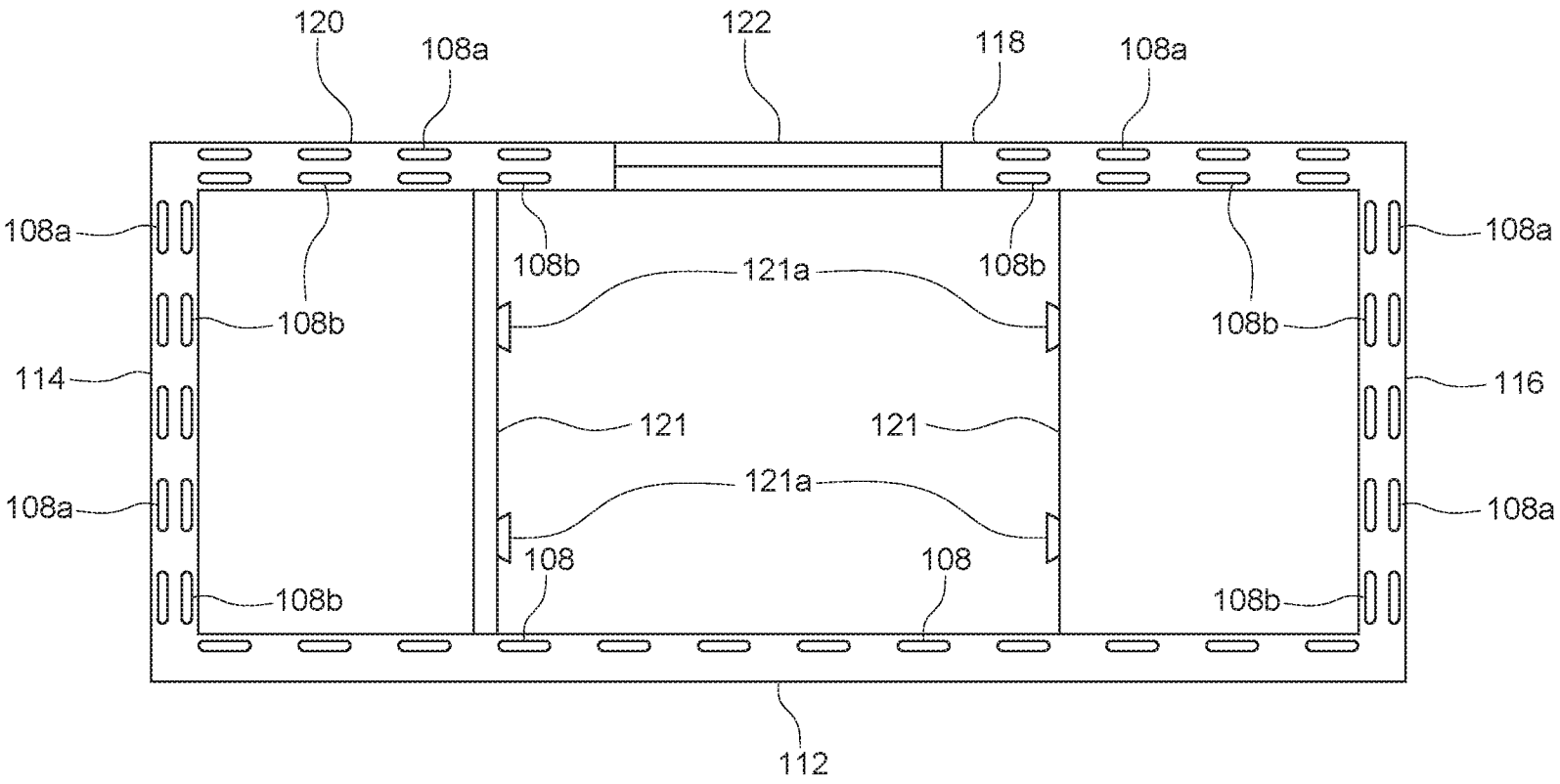
FIG. 2 is a top view of a body of a configurable container assembly according to one embodiment of the present invention.

Referring to FIG. 2, a top view of the body 104 is illustrated. As shown, the plurality of slots 108 can be located around a top perimeter of the body 104. The plurality of slots 108 can include a first set of slots 108*a* and a second set of slots 108*b* denoting a location on the top perimeter of the body 104. Typically, the first set of slots 108*a* can be located proximate an exterior of the walls and the second set of slots 108*b* can be located proximate an interior of the walls of the body 104. In a typical implementation, the back wall 116 may only include one set of slots 108. It is to be appreciated that embodiments are contemplated where the back wall includes two sets of slots 108.

The plurality of slots 108 can be implemented to receive one or more protrusions 152 included with each of the accessories 150*a*-150*n* to secure the accessories 150*a*-150*n* to the body 104. The plurality of slots 108 can generally each have the same shape and size. In some embodiments, a depth of the slots 108 can vary depending on a location of the slots. For instance, slots located proximate the exterior edges may be deeper to allow bigger accessories to be coupled proximate an outside of the body 104. In one example, a grill may include protrusions that are longer than protrusions used for smaller accessories. As shown, the plurality of slots 108 can have a generally elongated stadium shape. In some embodiments, the plurality of slots 108 can have a substantially rectangular shape. It is to be appreciated that other shapes for the slots are contemplated and not outside the scope of the present invention.

The left sidewall 112, the right sidewall 114, the front left wall 118, and the front right wall 120 can each include the first set of slots 108*a* located proximate an exterior of the top of the walls and the second set of slots 108*b* located proximate an interior of a top of the walls. As can be appreciated, accessories can be coupled to the second set of slots 108*b* when in a storage configuration and can be coupled to the first set of slots 108*a* and the second set of slots 108*b* when in an open configuration. For instance, an accessory 150*a* stored inside the container 102 when in transport (or storage) can be removed from the container 102 and can be attached to an outside of the container 102 via one of the first set of slots 108*a*.

As shown in FIG. 2, the pair of partition walls 121 can divide an interior of the container 104 into three spaces. In some embodiments, each of the partition walls 121 may include one or more compression clips 121*a* for securing one or more accessories 150*a*-150*n* inside the container 102. For instance, the table accessory 150*a* may interact with the compression clips 121*a* to be securely stored inside the container 104. As can be appreciated, the table accessory 150*a* may be stored vertically inside the container 104. Of note, other means for securing accessories 150*a*-150*n* inside the container 102 are contemplated and not outside the scope of the present invention. Compression clips are one example of a coupling mechanism and not meant to be limiting.

Figure 5A:
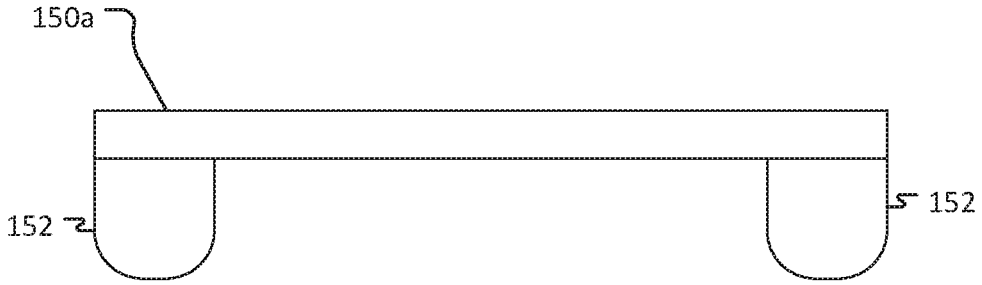
FIG. 5A is a back view of an accessory including protrusions according to one embodiment of the present invention.
Figure 5B:
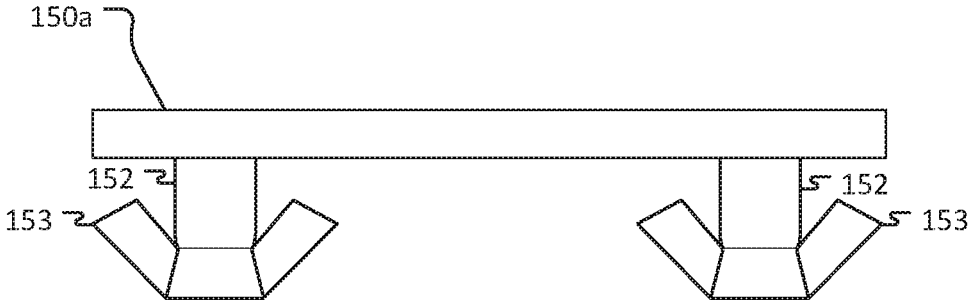
FIG. 5B is a back view of an accessory including protrusions according to one embodiment of the present invention.

The protrusions 152, as shown in FIGS. 5A-5B, included with each of the accessories 150*a*-150*n* can be configured to mate with the plurality of slots 108. Typically, the protrusions 108 can be configured to be inserted into and removed from the slots 108 to allow for the accessories 150*a*-150*n* to be placed where a user likes. In some embodiments, the protrusions 152 may include an engagement mechanism 153 to securely keep the protrusion 152 inside a slot 108. As can be appreciated, the engagement mechanism 153 can be configured to allow the protrusion 152 to be removed from the slot when warranted.

The front middle wall 122 can include a rotatable connection to the body 104. For instance, the front middle wall 122 can include a hinged coupling allowing the wall 122 to rotate from being substantially vertical to substantially horizontal. It is to be appreciated that other means of rotatably coupling the front middle wall 122 to the body 104 are contemplated.

Figure 4A:
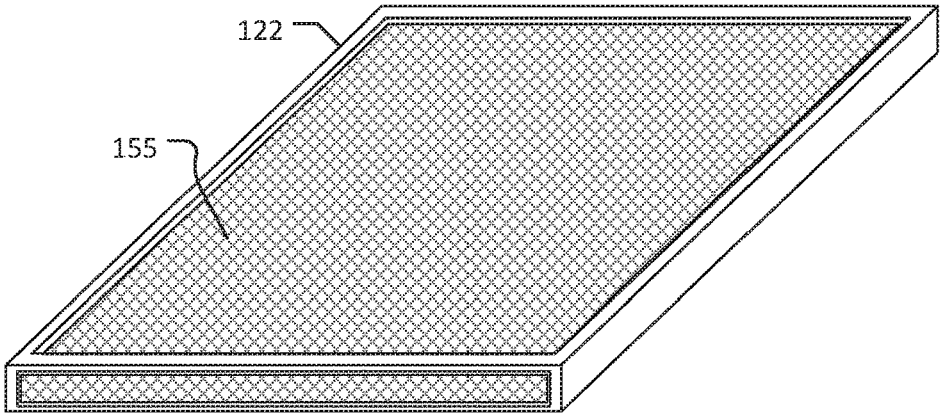
FIGS. 4A-4B are perspective views of a front middle wall of a configurable container assembly according to one embodiment of the present invention.
Figure 4B:
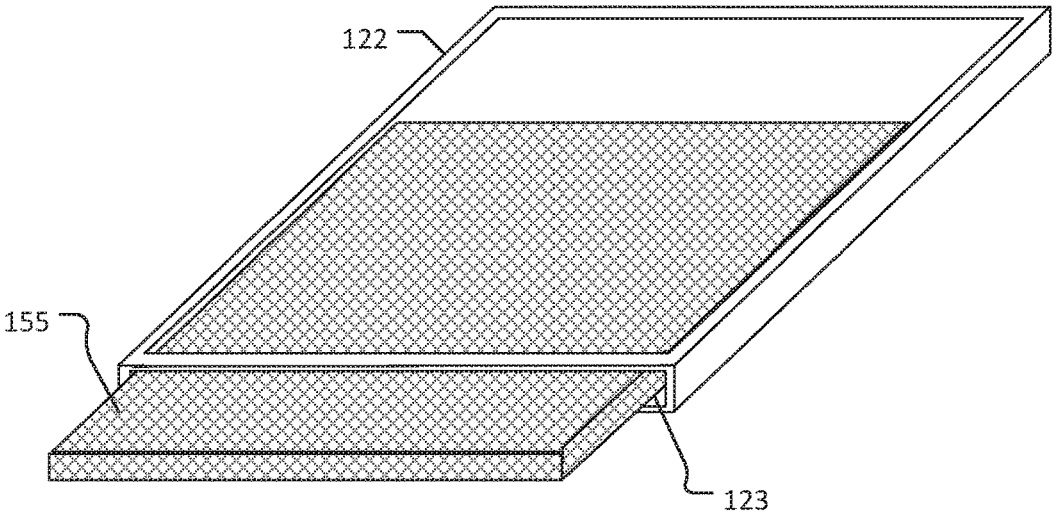

In one embodiment, as shown in FIGS. 4A-4B, the front middle wall 122 can include a slot 123 configured to removably receive a plate 155. In one example, the plate 155 can be a cutting board. The plate 155 can be removably inserted into the slot 123 of the front middle wall 122. In an exemplary implementation, a user can cut various foods on the plate 155 and then be able to remove the plate 155 for easy cleaning before transporting the configurable container assembly 100 from one location to another. Of note, other types of items may be designed to fit into the slot 123 of the front middle wall 122.

Figure 4C:
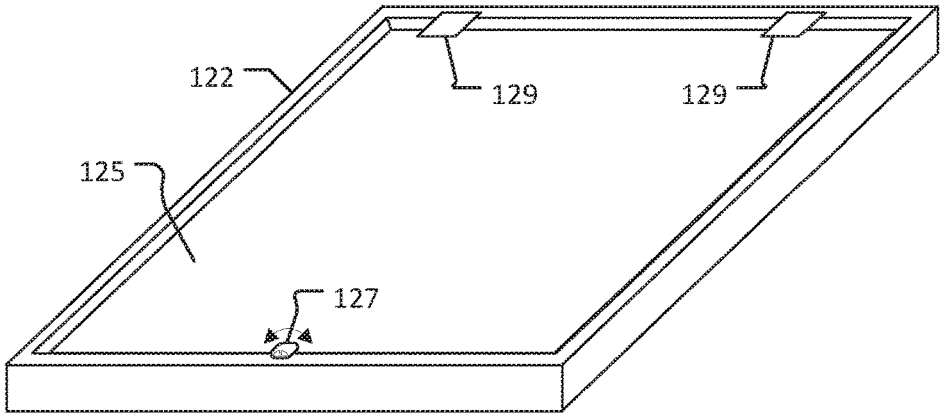
FIG. 4C is a perspective view of a front middle wall of a configurable container assembly according to one embodiment of the present invention.

In another embodiment, as shown in FIG. 4C, the front middle wall 122 may include a tray 125 for receiving the plate 155 therein. The front middle wall 122 can further include a means for securing the plate 155 in the tray 125.

Figure 3A:
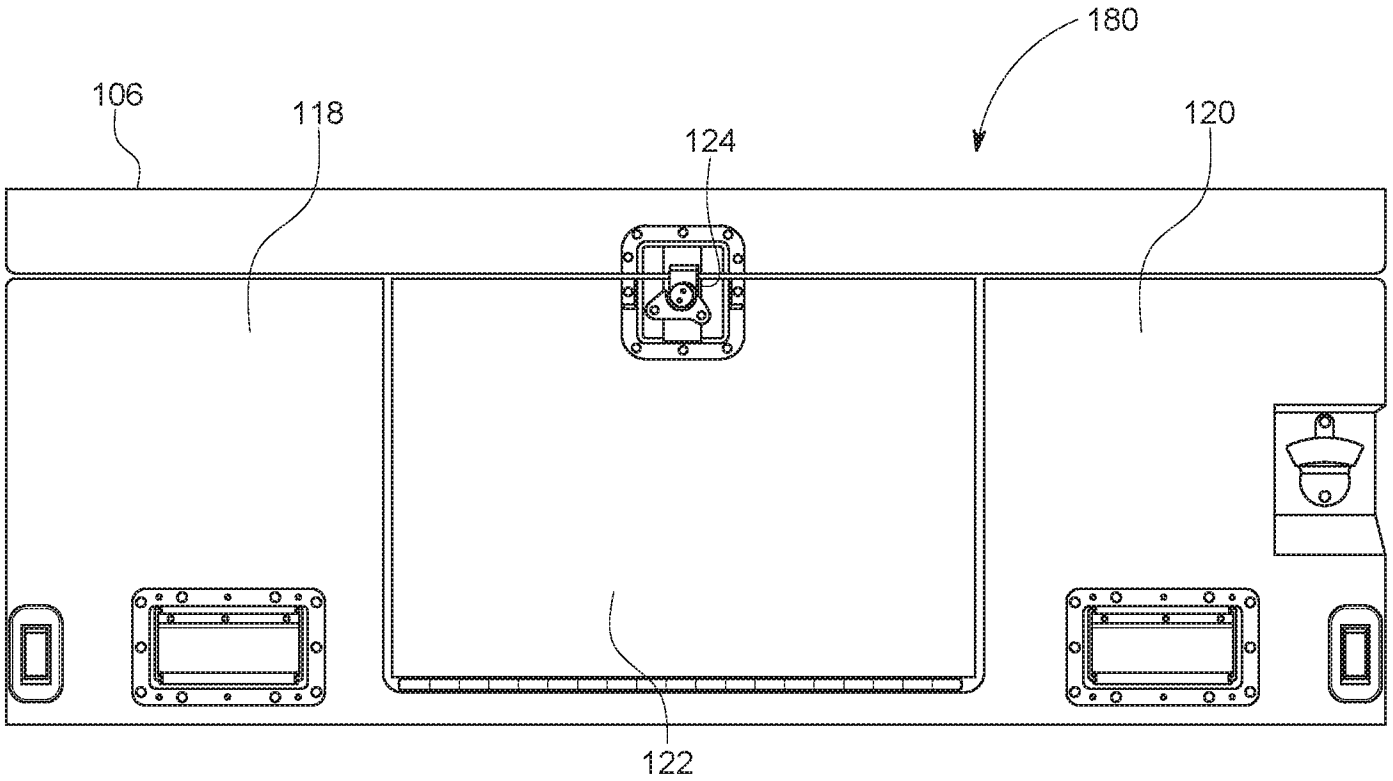
FIG. 3A is a front view of a configurable container assembly in a closed configuration according to one embodiment of the present invention.
Figure 3B:
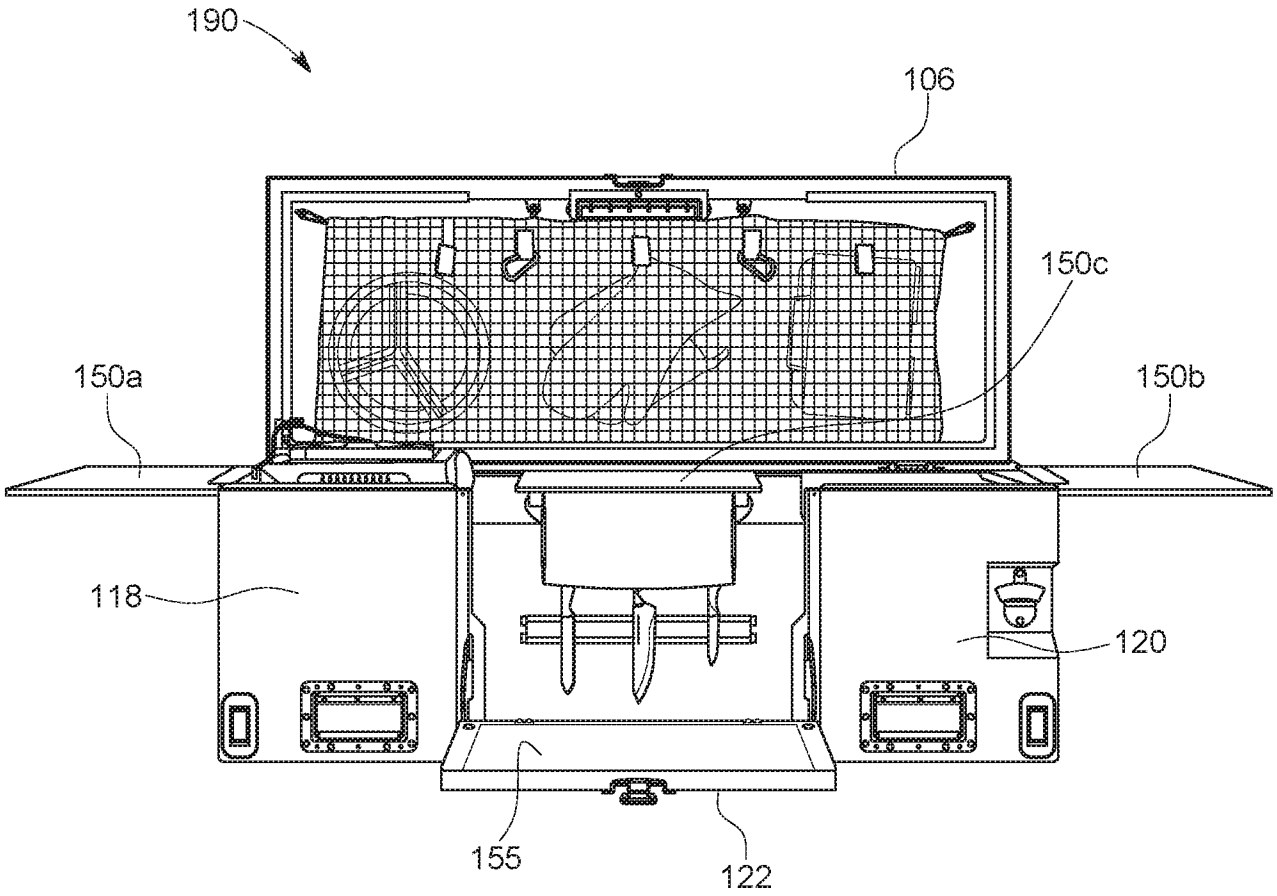
FIG. 3B is a front view of a configurable container assembly in an open configuration according to one embodiment of the present invention.

Referring to FIGS. 3A-3B, detailed diagrams of the configurable container assembly 100 in a closed configuration 180 and an open configuration 190 are illustrated. In a typical implementation, the configurable container assembly 100 can first be used in the closed configuration 180, transported to a desired location, and then be used in the open configuration 190.

The closed configuration 180 is shown in FIG. 3A. The closed configuration 180 can be implemented when the container 100 is not in use or being transported from one location to another. The closed configuration 180 can include the lid 106 being closed, each of the accessories 150*a*-150*n* being located inside the body 104, and the front middle wall 122 being rotated to substantially vertical and interfacing with the lid 106. In some embodiments, the front middle wall 122 and the lid 106 can include a locking mechanism 124. As can be appreciated, the locking mechanism 124 can be implemented to secure the front middle wall 122 in the vertical orientation as well as provide security for contents contained in the container 100.

The open configuration 190 is shown in FIG. 3B. The open configuration 190 can include the lid 106 being open, one or more accessories 150*a*-150*n* being coupled to the slots 108 of the body 104, and the front middle wall 122 being rotated to substantially horizontal. In the open configuration 190, the configurable container 100 can be used as a food preparation station. For instance, the one or more accessories 150*a*-150*n* may include a grill, a spice rack, and a table. The grill may be used to cook food, the spice rack can be used to provide condiments and spices for the food, and the table can be a preparation table where the food can be put together.

In one embodiment, the table accessory 150*a* may be a first removable dividing wall and the table accessory 150*b* may be a second removable dividing wall. In the closed configuration 180, the table accessories 150*a*-150*b* may be coupled to the partition walls 121 and interact with the compression clips 121*a* to secure the accessories 150*a*-150*b* in a vertical orientation. As can be appreciated, the accessories 150*a*-150*b* may act as dividing walls allowing for food or other objects to be securely stored in the container 104. When in the open configuration 190, the table accessories 150*a*-150*b* can be removed from an interior of the container 104 and placed on the sidewalls outside of the container 104.

Referring to FIGS. 4A-4B, the front middle wall 122 is shown with the plate 155. As shown generally in the figures, the plate 155 can be inserted into the slot 123 of the front middle wall 122. The plate 155 can be removed from the slot 123 to allow for cleaning or switching out to another type of plate. For instance, a cutting board may be used and then removed for cleaning.

Referring to FIG. 4C, a perspective view of the front middle wall 122 and the tray 125 is shown. As can be appreciated, the plate 155 may be placed into the tray 125. A rotating locking mechanism 127 and a pair of tabs 129 can be implemented to removably secure the plate 155 in the tray 125. In an example implementation, the rotating locking mechanism 127 can be rotated such that the mechanism 127 does not cover the tray 125. The plate 155 may then be inserted with a distal end inserted under the pair of tabs 129 and then placed completely inside the tray 125. The locking mechanism 127 may then be rotated to cover the plate 155 and lock the plate 155 in place.

Referring to FIGS. 5A-5B, close up views of different types of protrusions 152 are illustrated. As can be appreciated, the accessories 150-150*n* may include one or more protrusions 152 depending on a size of the accessory. For instance, a cup holder accessory may include only a single protrusion. In another instance, a food tray may include three protrusions to provide support for heavy foods.

As shown in FIG. 5B, the protrusions 152 may include the engagement mechanism 153 to more securely attach one of the accessories 150*a*-150*n* to container 100. As can be appreciated, the engagement mechanisms 153 can be inserted into one of the slots 108 and the engagement mechanisms 153 can interface with an upper inside surface of the slot 108.

Figure 6:
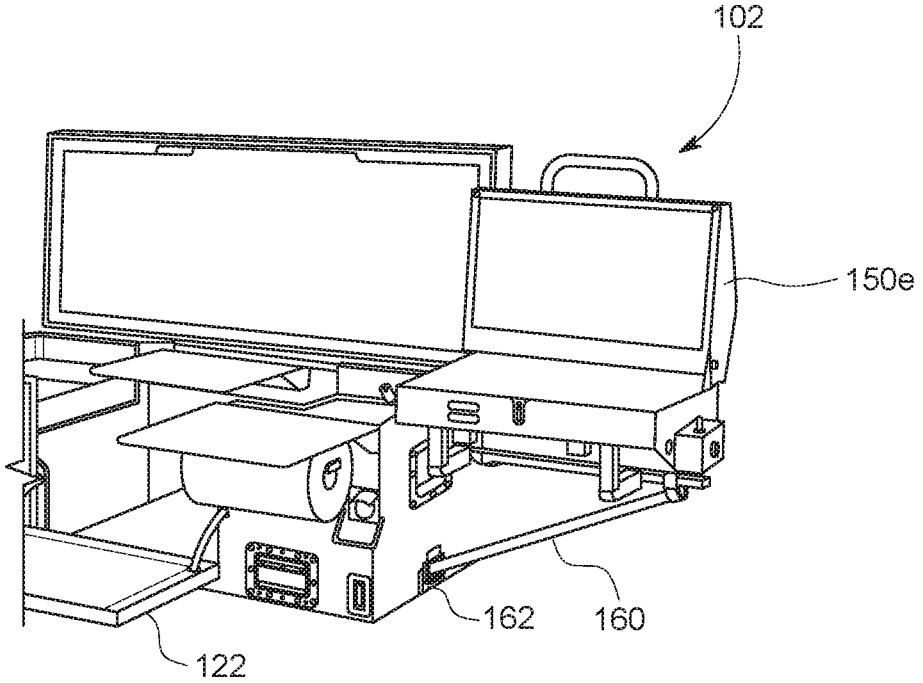
FIG. 6 is a perspective view of a configurable container assembly according to one embodiment of the present invention.

Referring to FIG. 6, an attachment mechanism 160 is illustrated. The attachment mechanism 160 can be implemented to secure a grill 150*e* to the container 102. As shown, the attachment mechanism 160 can be a rod that can attach to a side wall of the container 102 and to a side of the grill 150*e*. The grill 150*e* can include one or more protrusions 152 on an opposite side of where the attachment mechanism 160 couples to the grill 150*e*. As shown, the side wall of the container 102 can include an external slot 162 for receiving a first end of the rod 160. A second end of the rod 160 can be coupled to the grill 150*e*. Of note, the attachment mechanism 160 can be removably coupled to the container 102.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A configurable container assembly comprising:

a container defined by:

a bottom;

a left sidewall including a first set of slots located on top of and proximate an interior edge of the left sidewall and a second set of slots located on top of and proximate an exterior edge of the left sidewall;

a right sidewall including a third set of slots located on top of and proximate an interior edge of the right sidewall and a fourth set of slots located on top of and proximate an exterior edge of the right sidewall;

a front left wall including a fifth set of slots located on top of and proximate an interior edge of the front left wall and a sixth set of slots located on top of and proximate an exterior edge of the front left wall;

a front right wall including a seventh set of slots located on top of and proximate an interior edge of the front right wall and an eighth set of slots located on top of and proximate an exterior edge of the front right wall;

a back wall including a ninth set of slots located on top of and proximate an inside edge of the back wall;

a lid coupled to the back wall; and a front middle wall located between the front left wall and the front right wall, the front middle wall adapted to rotate between being vertical and horizontal;

a first accessory including one or more protrusions, wherein the one or more protrusions are adapted to be inserted into one of the slots of the back wall, the left sidewall, the right sidewall, the front left wall, and the front right wall.

2. The configurable container of claim 1, wherein the container includes a first removable interior dividing wall and a second removable interior dividing wall.

3. The configurable container of claim 2, wherein the first removable interior dividing wall and the second removable interior dividing wall each include one or more protrusions configured to mate with the slots.

4. The configurable container of claim 1, wherein each slot of the first set of slots is aligned side-by-side with a respective slot of the second set of slots on the top of the left sidewall.

5. The configurable container of claim 1, wherein each slot of the third set of slots is aligned side-by-side with a respective slot of the fourth set of slots on the top of the right sidewall.

6. The configurable container of claim 1, wherein each slot of the fifth set of slots is aligned side-by-side with a respective slot of the sixth set of slots on the top of the front left wall.

7. The configurable container of claim 1, wherein each slot of the seventh set of slots is aligned side-by-side with a respective slot of the eighth set of slots on the top of the front right wall.

8. The configurable container of claim 1, wherein in an open configuration (i) the lid is open, (ii) the first accessory is mated with one or more slots of the second set of slots, the fourth set of slots, the sixth set of slots, or the eighth set of slots, and (iii) the front middle wall horizontally extends from the bottom of the container.

9. The configurable container of claim 1, wherein in a closed configuration (i) the lid is closed, (ii) the first accessory is mated with one or more slots of the first set of slots, the third set of slots, the fifth set of slots, the seventh set of slots, or the ninth set of slots, and (iii) the front middle wall vertically extends from the bottom of the container and is adjacent to the front left wall and the front right wall.

10. A configurable container assembly comprising:

a container defined by:

a bottom;

a left sidewall and a right sidewall;

a back wall;

a lid coupled to the back wall;

a front left wall and a front right wall; and a front middle wall located between the front left wall and the front right wall, the front middle wall adapted to rotate between being vertical and horizontal;

a first plurality of slots located on top of and proximate to an interior edge of the back wall, the left sidewall, the right sidewall, the front left wall, and the front right wall;

a second plurality of slots located on top of and proximate to an exterior edge of the left sidewall, the right sidewall, the front left wall, and the front right wall;

a plurality of accessories configured to mate with the first plurality of slots and the second plurality of slots;

a first configuration wherein (i) the lid is closed, (ii) each of the plurality of accessories are located inside the container, (iii) at least one of the plurality of accessories is mated with one of the first plurality of slots, and (iv) the front middle wall is vertical; and a second configuration wherein (i) the lid is open, (ii) one or more of the plurality of accessories are located outside of the container, (iii) the front middle wall is horizontal, and (iv) at least one of the plurality of accessories is mated with one or more of the second plurality of slots.

11. The configurable container assembly of claim 10, wherein in the second configuration at least one of the plurality of accessories is mated with one or more of the first plurality of slots.

12. The configurable container assembly of claim 10, wherein the first plurality of slots are oriented substantially parallel with the second plurality of slots on the left sidewall, the right sidewall, the front right wall, and the front left wall.

13. The configurable container assembly of claim 10, wherein the container further includes a first interior partition wall and a second interior partition wall.

14. The configurable container of claim 13, wherein the first interior partition wall and the second interior partition wall each include one or more compression clips.

15. The configurable container of claim 14, wherein at least one of the plurality of accessories are configured to be secured by the one or more compression clips.

16. The configurable container of claim 10, wherein a first accessory of the plurality of accessories is mated with the first plurality of slots on the left sidewall and a second accessory of the plurality of accessories is mated with the second plurality of slots on the left sidewall.

17. The configurable container of claim 16, wherein a third accessory of the plurality of accessories is mated with the first plurality of slots on the right sidewall and a fourth accessory of the plurality of accessories is mated with the second plurality of slots on the right sidewall.

18. The configurable container of claim 10, wherein the container is manufactured using a rotomolding process.

19. The configurable container of claim 10, wherein the front middle wall includes a removably secured cutting board.

20. A configurable container assembly comprising:

a container including (i) a first plurality of slots located on top of and proximate to an interior edge of a back wall, a left sidewall, a right sidewall, a front left wall, and a front right wall, (ii) a second plurality of slots located on top of and proximate to an exterior edge of the left sidewall, the right sidewall, the front left wall, and the front right wall, (iii) a lid, and (iv) a front middle wall;

a plurality of accessories configured to mate with the first plurality of slots and the second plurality of slots;

a first configuration wherein (i) the lid is closed, (ii) each of the plurality of accessories are located inside the container, (iii) at least one of the plurality of accessories is mated with one of the first plurality of slots, and (iv) the front middle wall is vertical; and a second configuration wherein (i) the lid is open, (ii) one or more of the plurality of accessories are located outside of the container, (iii) the front middle wall horizontally extends from a bottom of the container, and (iv) at least one of the plurality of accessories is mated with one or more of the second plurality of slots.

* * * * *